US009423739B2

(12) United States Patent
Akiyama

(10) Patent No.: US 9,423,739 B2
(45) Date of Patent: Aug. 23, 2016

(54) ENDLESS BELT FOR FIXING, FIXING DEVICE, AND METHOD FOR PRODUCING ENDLESS BELT FOR FIXING

(71) Applicant: CANON KABUSHIKI KAISHA, Tokyo (JP)

(72) Inventor: Naoki Akiyama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 454 days.

(21) Appl. No.: 13/840,671

(22) Filed: Mar. 15, 2013

(65) Prior Publication Data

US 2013/0264211 A1 Oct. 10, 2013

(30) Foreign Application Priority Data

Apr. 5, 2012 (JP) ..... 2012-086031

(51) Int. Cl.

| | |
|---|---|
| ***G03G 15/20*** | (2006.01) |
| ***C25D 1/00*** | (2006.01) |
| ***C25D 3/56*** | (2006.01) |
| ***C25D 5/14*** | (2006.01) |
| ***C25D 5/50*** | (2006.01) |
| ***C25D 7/04*** | (2006.01) |

(52) U.S. Cl.

CPC ..... *G03G 15/2057* (2013.01); *C25D 1/00* (2013.01); *C25D 3/562* (2013.01); *C25D 5/14* (2013.01); *C25D 5/50* (2013.01); *C25D 7/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,104,903 | A * | 8/2000 | Hara et al. | 399/265 |
| 2001/0019677 | A1* | 9/2001 | Ishizaki et al. | 399/329 |
| 2012/0080423 | A1* | 4/2012 | Takeda | 219/600 |
| 2012/0163886 | A1* | 6/2012 | Suzuki | 399/329 |

FOREIGN PATENT DOCUMENTS

| | | | |
|---|---|---|---|
| JP | 2005031485 | A | 2/2005 |
| JP | 2005121825 | A | 5/2005 |
| JP | 2007-286616 | A | 11/2007 |
| JP | 2010-54666 | A | 3/2010 |
| JP | 2010217347 | A | 9/2010 |

* cited by examiner

*Primary Examiner* — Clayton E Laballe
*Assistant Examiner* — Jas Sanghera
(74) *Attorney, Agent, or Firm* — Canon USA, Inc. IP Division

(57) ABSTRACT

An endless belt for fixing includes a base layer made of nickel, wherein the base layer includes a first layer, a second layer, and a third layer provided between the first layer and the second layer, and a toner parting layer provided on the base layer, wherein a content rate of an element for enhancing hardness in the first layer and the second layer is lower than that in the third layer.

22 Claims, 8 Drawing Sheets

ENDLESS BELT FOR FIXING, FIXING DEVICE, AND METHOD FOR PRODUCING ENDLESS BELT FOR FIXING

BACKGROUND OF THE INVENTION

1. Field of the Invention

The present invention relates to an endless belt for fixing, a fixing device, and a method for producing the endless belt for fixing. These endless belt for fixing and fixing device can be used in copying machines, printers, facsimiles, and image forming apparatuses, such as multifunction peripherals including a plurality of these functions.

2. Description of the Related Art

Conventionally, fixing processing is carried out by heating and pressing a toner image formed on a recording material using a fixing device in an image forming apparatus.

It is proposed to use a fixing belt (an endless belt) using nickel as a base material in such a fixing device.

Specifically, the fixing belts discussed in Japanese Patent Application Laid-Open No. 2010-54666 and No. 2007-286616 are the fixing belts using nickel as the base material, which is produced by an electrocasting method. The electrocasting method is a method for producing a metal film, in which a metal layer is electrically precipitated and grown like a plating step in an electrolytic solution onto a cylindrical surface of carbon or the like and subsequently a shaping with a mold is carried out.

In Japanese Patent Application Laid-Open No. 2010-54666 and No. 2007-286616, phosphorus is added to an entire surface in a thickness direction of the base material (nickel) of the fixing belt for the purpose of enhancing durability of the base material.

For example, in Japanese Patent Application Laid-Open No. 2010-54666, a metal structure is grown from an internal surface toward an external surface of the base material using an electrolytic solution in which a phosphorus ion has been added to a nickel ion, while a concentration of the phosphorus ion in the electrolytic solution is gradually increased in that process. As a result, hardness in the external surface of the base material in the fixing belt is lower than that in the internal surface However, the durability of the fixing belt cannot be sufficiently enhanced depending on how to add phosphorus to the base material in the fixing belt, and consequently an exchange lifetime of the fixing belt is likely shortened.

SUMMARY OF THE INVENTION

The present invention is directed to an endless belt for fixing with high durability.

According to an aspect of the present invention, an endless belt for fixing includes a base layer made of nickel, wherein the base layer includes a first layer, a second layer, and a third layer provided between the first layer and the second layer, and a toner parting layer provided on the base layer, wherein a content rate of an element for enhancing hardness in the first layer and the second layer is lower than that in the third layer.

According to yet another aspect of the present invention, an endless belt for fixing includes a base layer made of nickel, wherein the base layer includes an innermost surface layer, an outermost surface layer, and an intermediary layer provided between the innermost surface layer and the outermost surface layer, and a toner parting layer provided on the base layer, wherein phosphorus is added to the intermediary layer whereas phosphorus is not added to the innermost surface layer and the outermost surface layer.

According to yet another aspect of the present invention, an endless belt for fixing includes a base layer made of nickel, wherein the base layer includes an innermost surface layer, an outermost surface layer, and an intermediary layer provided between the innermost surface layer and the outermost surface layer, and a toner parting layer provided on the base layer, wherein phosphorus is added to the innermost surface layer and the intermediary layer whereas phosphorus is not added to the outermost surface layer.

The present invention is also directed to a fixing device equipped with an endless belt for fixing with high durability.

According to an aspect of the present invention, a fixing device includes an endless belt that heats a toner image on a recording material at a nip portion, wherein the endless belt includes a base layer made of nickel, and a toner parting layer provided on the base layer, and a rotating member that forms the nip portion together with the endless belt, wherein the base layer includes a first layer, a second layer, and a third layer provided between the first layer and the second layer, and wherein a content rate of an element for enhancing hardness in the first layer and the second layer is lower than that in the third layer.

According to another aspect of the present invention, a fixing device includes an endless belt that heats a toner image on a recording material at a nip portion, wherein the endless belt includes a base layer and a toner parting layer provided on the base layer, and a rotating member that forms the nip portion together with the endless belt, wherein the base layer includes a first layer, a second layer, and a third layer provided between the first layer and the second layer, and wherein micro Vickers hardness in the first layer and the second layer is smaller than that in the third layer.

According to yet another aspect of the present invention, a fixing device includes an endless belt that heats a toner image on a recording material at a nip portion, wherein the endless belt includes a base layer and a toner parting layer provided on the base layer, and a rotating member that forms the nip portion together with the endless belt, wherein the base layer includes an innermost surface layer, an outermost surface layer, and an intermediary layer provided between the innermost surface layer and the outermost surface layer, and wherein phosphorus is added to the intermediary layer whereas phosphorus is not added to the innermost surface layer and the outermost surface layer.

According to yet another aspect of the present invention, a fixing device includes an endless belt that heats a toner image on a recording material at a nip portion, wherein the endless belt includes a base layer and a toner parting layer provided on the base layer, and a rotating member that forms the nip portion together with the endless belt, wherein the base layer includes an innermost surface layer, an outermost surface layer, and an intermediary layer provided between the innermost surface layer and the outermost surface layer, and wherein phosphorus is added to the innermost surface layer and the intermediary layer whereas phosphorus is not added to the outermost surface layer.

The present invention is also directed to a method for producing an endless belt for fixing with high durability.

According to an aspect of the present invention, a method for producing an endless belt for fixing includes growing an innermost surface layer on a surface of a cylindrical electrode by an electrocasting method using an electrolytic solution of a nickel ion to which a phosphorus ion has been added, growing an intermediary layer on the innermost surface layer by the electrocasting method using an electrolytic solution of the nickel ion in which a concentration of the phosphorus ion is higher than that in the electrolytic solution in which the innermost surface layer has been grown, and growing an outermost surface layer on the intermediary layer by the electrocasting method using an electrolytic solution of the nickel ion in which the concentration of the phosphorus ion is lower than that in the electrolytic solution in which the intermediary layer has been grown.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<Image Forming Apparatus>

Figure 1:
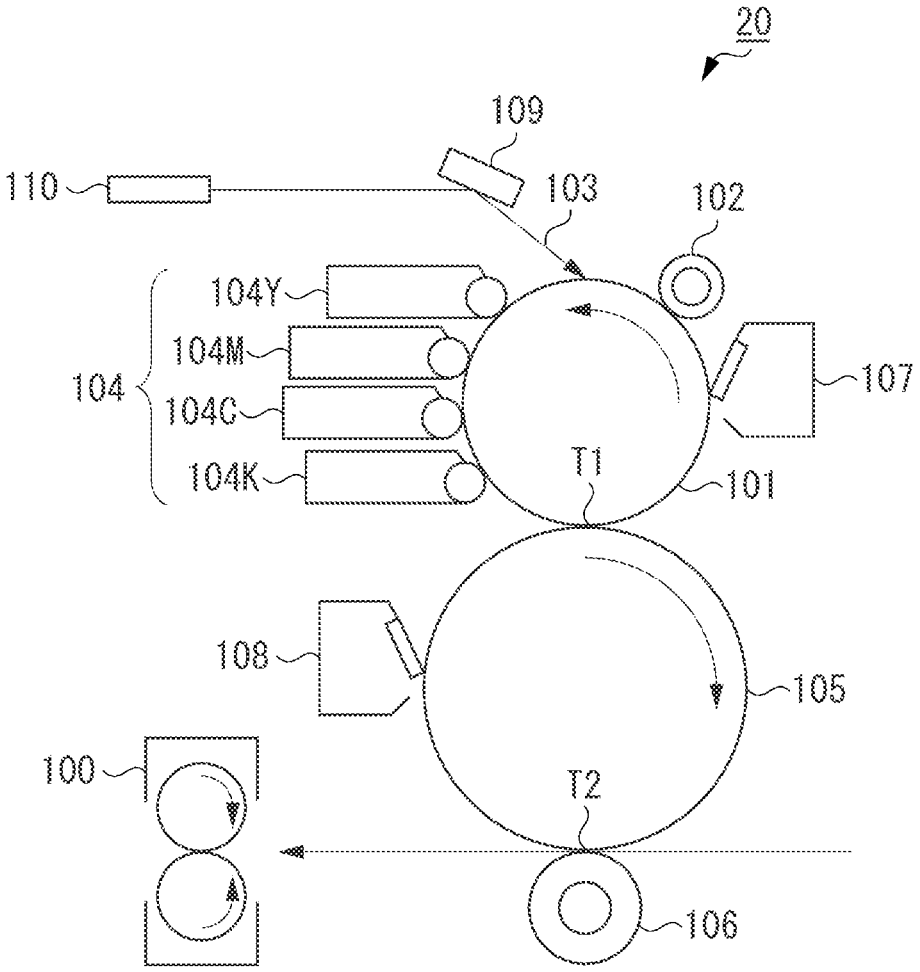
FIG. 1 is a view illustrating a configuration of an image forming apparatus.

FIG. 1 is a view illustrating an image forming apparatus. As illustrated in FIG. 1, the image forming apparatus 20 is a full-color printer of one drum type intermediate transfer system, in which developing units for yellow 104Y, magenta 104M, cyan 104C, and black 104K, are aligned along a photosensitive drum 101.

The image forming apparatus 20 forms a full-color toner image by superimposing respective color toner images on an intermediate transfer drum 105 with separating a transfer roller 106 and an intermediate transfer drum cleaning device 108 from the intermediate transfer drum 105. Subsequently, the transfer roller 106 is contacted to the intermediate transfer drum 105 to form a secondary transfer portion T2. Then, a recording material P is conveyed to the secondary transfer portion T2 to be secondarily transferred the full-color toner image. A surface of the intermediate transfer drum 105 after transferring the full-color toner image is cleaned by the intermediate transfer drum cleaning device 108 removing a residual transfer toner.

The recording material P after passing through the secondary transfer portion T2 is introduced into a fixing device 100, and an unfixed toner image carried on the recording material P is fixed (undergone image heating treatment) at a nip portion. The fixed recording material P is discharged from the apparatus to complete a series of image forming operations.

The respective toner images of yellow, magenta, cyan, and black are similarly formed on the photosensitive drum 101 by the image forming apparatus 20 switching a developing units 104. Here, formation of a yellow toner image will be described, and redundant descriptions for magenta, cyan, and black toner images are not repeated.

The photosensitive drum 101 is driven to rotate at a predetermined process speed (a circumferential velocity) in an counterclockwise direction indicated by an arrow. A charging device 102 charges the surface of the photosensitive drum 101 to a uniform potential using a charging roller in a rotation process of the photosensitive drum 101.

An exposing device 110 scans the charged surface of the photosensitive drum 101 with a laser beam 103 to expose the charged surface of the photosensitive drum 101 based on input image information. The exposing device 110 outputs the laser beam 103 that is modulated (on/off) according to time-series electric digital pixel signals of the image information from an image signal generation device (not illustrated in the figure), such as an image reading apparatus. As a result, an electrostatic image corresponding to the image information is formed on the photosensitive drum 101. A mirror 109 deflects the laser beam 103 to a position to be exposed on the photosensitive drum 101.

A yellow developing unit 104Y charges a yellow toner and supplies the charged yellow toner to the photosensitive drum 101 to visualize the electrostatic image on the photosensitive drum 101 by the yellow toner.

On the intermediate transfer drum 105, a direct current voltage with a polarity opposite to a charging polarity of the toner is applied. The yellow toner image is primarily transferred from the photosensitive drum 101 at a primary transfer portion T1 that is a contact portion of the photosensitive drum 101 and the intermediate transfer drum 105. A photosensitive drum cleaning device 107 cleans a residual transfer toner left on the photosensitive drum 101.

Such a process cycle of charging, exposing, developing, primary transfer, and cleaning steps are similarly repeated to form a magenta toner image (the developing unit 104M works), a cyan toner image (the developing unit 104C works), and a black toner image (the developing unit 104K works).

The intermediate transfer drum cleaning device 108 is contactable to and separable from the intermediate transfer drum 105, and is brought into contact with the intermediate transfer drum 105 only when cleaning the intermediate transfer drum 105.

The transfer roller 106 is also contactable to and separable from the intermediate transfer drum 105, and is brought into contact with the intermediate transfer drum 105 only at a time of the secondary transfer.

<Fixing Device>

Figure 2:
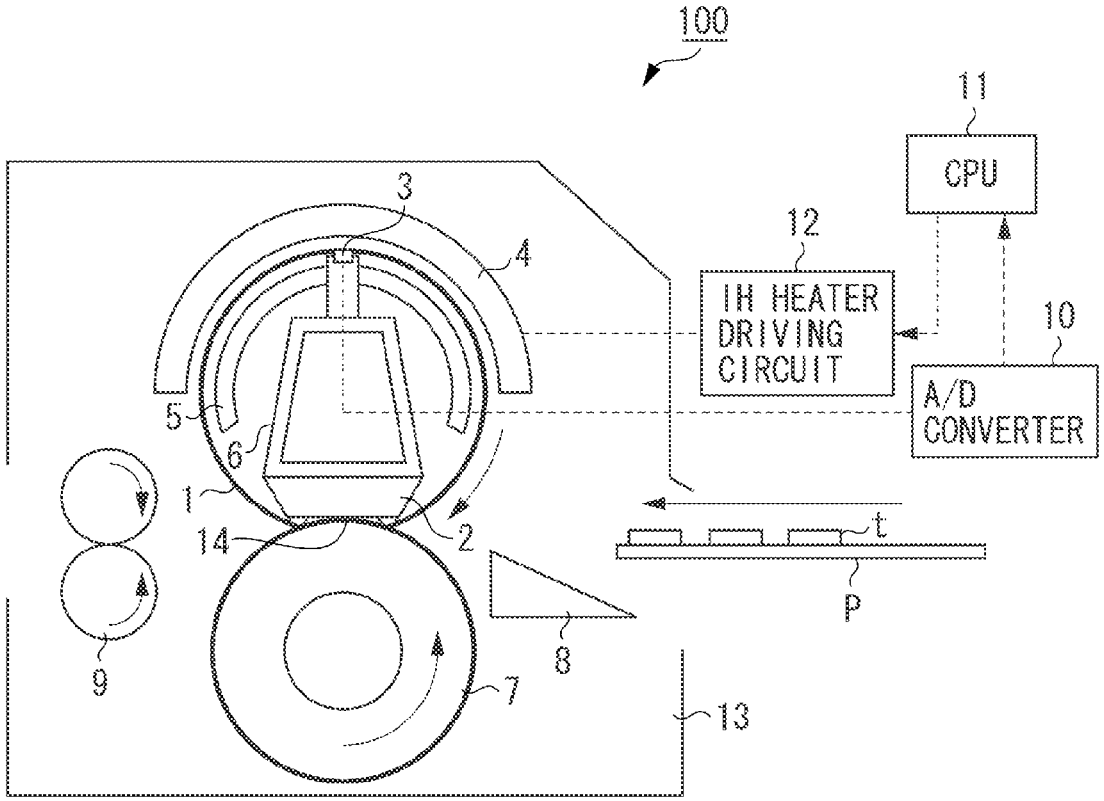
FIG. 2 is a view illustrating a configuration of a fixing device.

FIG. 2 is a view illustrating the fixing device. As illustrated in FIG. 1, the image forming apparatus 20 employs a heating fixing system, in which an unfixed toner image is heated and melted to be fixed on the recording material, in terms of safety and good fixability as a fixing system for fixing the unfixed toner image on the recording material. The fixing device 100 employs a belt heating system in terms of quick start and saving energy. An outline configuration of the fixing device is schematically illustrated in FIG. 2.

As illustrated in FIG. 2, an induction heating (IH) heater 4 is a magnetic field-generating member that generates an alternate current magnetic field for heating a fixing belt 1 by electromagnetic induction. An inner core 5 is a magnetic field induction member that induces magnetic flux to form a magnetic path.

The fixing device 100 uses the fixing belt 1 (the endless belt for fixing) including a base layer formed using an electrocasting treatment and made of nickel. The fixing belt 1 is a cylindrical endless belt including an elastic layer and is heated with the electromagnetic induction by the IH heater 4 that is a heating mechanism to produce the heat. In the fixing belt 1, a silicon rubber layer (an elastic layer) having a thickness of about 450 μm is formed on the base layer of an electrocast nickel belt formed into a cylindrical shape having a thickness of 50 μm using the electrocasting method. The elastic layer of the fixing belt 1 is coated with a perfluoroalkoxy (PFA) resin tube (a topmost-surface layer) having a thickness of about 40 μm.

A silicone-based oil is applied onto an inner surface of the fixing belt 1 to ensure a sliding property between a belt guide 2 and the inner surface of the fixing belt 1. KF-96 having a kinetic viscosity coefficient of 0.01 $m^2$/sec and manufactured by Shin-Etsu Chemical Co., Ltd. is used as the silicone-based oil.

A pressing roller 7 forms a nip portion 14 together with the fixing belt 1. The pressing roller 7 has a multilayer structure, in which an elastic layer of silicon rubber having a thickness of about 3 mm is formed on a cored bar made from stainless and a PFA resin tube having a thickness of about 40 μm is laminated with a circumferential surface of the elastic layer. Both ends of the cored bar of the pressing roller 7 is axle-borne and held rotatably between side plates of a front side and a back side not illustrated in the figure in a device frame 13 of the fixing device 100.

The pressing roller 7 is driven to rotate at a predetermined circumferential velocity in an arrow direction. The fixing belt 1 press-contacted with the pressing roller 7 is driven together with the pressing roller 7, and rotates at a predetermined speed. At this time, an inner surface of the fixing belt 1 is driven to rotate around an outer surface of the belt guide 2 and the inner core 5 in an arrow direction while closely contacting a lower surface of the belt guide 2 and sliding.

A fixing unit including the fixing belt 1, the belt guide 2, the IH heater 4, and the like is placed on an upper side of the pressing roller 7 in parallel with the pressing roller 7. The belt guide 2 is formed of a liquid crystal polymer resin having high heat resistance, and has the heat resistance. The fixing belt 1 is fitted onto the belt guide 2 with some flexibility. A stay 6 supports the inner core 5, a thermistor 3, and the belt guide 2. Both ends of the stay 6 are urged against the pressing roller 7 with a force of 156.8 N (16 kgf) each and a total pressure 313.6 N (32 kgf) by a pressing mechanism not illustrated in the figure. As a result, the lower surface of the belt guide 2 is brought into contact with the pressing roller 7 over the fixing belt 1 by being press-contacted therewith with a predetermined pressing force as competition with the elastic layer of the pressing roller 7, thereby forming the nip portion 14 having a predetermined width required for the fixing.

In the fixing device 100, the recording material P, on which the unfixed toner image t has been transferred, is introduced to the nip portion 14 formed between the fixing belt 1 and the pressing roller 7, and is nipped and conveyed together with the fixing belt 1. The fixing device 100 fixes the unfixed toner image on the recording material P with a pressing force at the nip portion 14 while the heat of the fixing belt 1 heated by the IH heater 4 is given to the recording material P.

The fixing device 100 supplies no power distribution to the IH heater 4 during standby. The fixing device 100 supplies the power to the IH heater 4 after the image forming apparatus 20 receives a printing signal, so that the fixing belt 1 is made heatable before the recording material reaches the fixing device 100. Thus, the fixing device 100 is an excellent image heating device that does not waste the energy in terms of saving the energy.

The thermistor 3 is placed on a backside of the fixing belt 1 and plays a function to detect a temperature of the fixing belt 1. The thermistor 3 is connected to a central processing unit (CPU) 11 via an analog-to-digital (A/D) converter 10.

The central processing unit 11 controls the power distribution to the IH heater 4 so that the temperature of the fixing belt 1 detected by the thermistor 3 maintains a target temperature (a set temperature). The central processing unit 11 reflects temperature information obtained by sampling outputs from the thermistor 3 in a predetermined cycle to temperature control. The central processing unit 11 determines the temperature control for the IH heater 4 based on the outputs from the thermistor 3, and controls the power distribution to the IH heater by an IH heater driving circuit unit 12 that is a power supply unit. The central processing unit 11 controls the temperature by a proportional control system, in which electric power in proportion to a difference (a temperature difference) between a detected temperature by the thermistor 3 and the target temperature is applied to the IH heater 4. Other systems, such as a proportional-integral-derivative (PID) control system, may also be employed without being limited to such a system.

In the fixing device 100, a hot offset occurs in some cases when the temperature of the fixing belt 1 becomes 180° C. or above in the case of using the recording material with a grammage of 64 g/$m^2$. Also, the cold offset occurs in some cases when the temperature of the fixing belt 1 becomes 160° C. or below in the case of using the recording material with a grammage of 105 g/$m^2$. The central processing unit 11 controls the power distribution to the IH heater 4 to keep the temperature of the fixing belt 1 at 170° C. so that the temperature of the fixing belt 1 does not become the aforementioned temperature.

<Bending of Fixing Belt>

Figure 3:
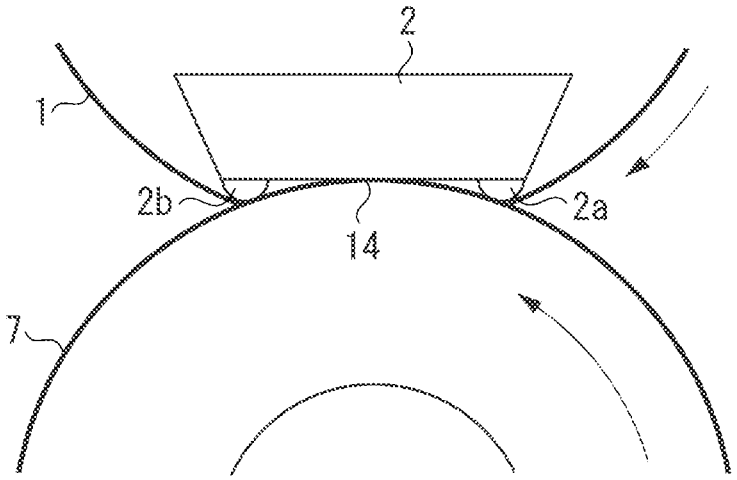
FIG. 3 is a magnified view illustrating a vicinity of a nip portion of the fixing device.

FIG. 3 is a magnified view illustrating a vicinity of the nip portion 14 in the fixing device 100. As illustrated in FIG. 2, the pressing roller 7 heats the toner image and the recording material by rotating at a high speed in a state where pressure of 200 to 500 N is given by the pressing roller 7. The nickel belt in the base layer in the fixing belt 1 has a thickness of 50 μm, which is thin, and further has the flexibility. Thus, the exchange lifetime of the nickel belt is sometimes shortened due to bending at handling and accumulation of metal fatigue.

As illustrated in FIG. 3, the belt guide 2 plays a role to curve the fixing belt 1 to project into the elastic layer of the pressing roller 7 and to adjust the shape of the vicinity of an outlet of the nip portion 14 for separating the recording material P. An upstream jaw 2*a* is located on a side of an inlet for the recording material P in the lower part of the belt guide 2, and enhances an image quality by pushing down the fixing belt 1. A downstream jaw 2*b* is located on a side of the outlet for the recording material P in the lower part of the belt guide 2, and separates the recording material P by pushing down the fixing belt 1.

The fixing belt 1 is bent from an inside to an outside when passing a lowermost part of the upstream jaw 2*a* and the downstream jaw 2*b* (hereinafter, referred to as sequential bending). The fixing belt 1 is bent from the outside to the inside after passing the upstream jaw 2*a* to the vicinity of a center of the nip portion 14 (hereinafter, referred to as reverse bending). The fixing belt 1 is in a state of the reverse bending after passing near a center of the nip portion 14 to near the downstream jaw 2*b*. The fixing belt 1 passes the nip portion 14 with continuously undergoing the sequential bending and the reverse bending as described above.

To increase strength of the fixing belt 1 against thermal deformation due to heating, phosphorus is blended to nickel to increase micro Vickers hardness, increase tensile strength and sufficiently increase the durability. By blending the phosphorus, the micro Vickers hardness is increased, and the strength against the deformation due to an external force and heat shrinkage is increased.

However, repetitive fatigue strength due to bending typified by the MIT test is sometimes decreased by increasing the hardness of the fixing belt 1. When phosphorus is blended, if an amount of contained phosphorus is increased, a defect called a pit is easily formed on the surface of the nickel belt formed by the electrocasting method. When the concentration of phosphorus is constant in a thickness direction of the belt, the amount of phosphorus on the surface is increased, and thus, the pit is easily formed on the surface. If the defect is present on the surface of the nickel belt, when the belt is bent, strain is concentrated to the defect portion to easily become a start point of cracking and thus reduce the fatigue strength.

Thus, in the following exemplary embodiment, the fixing belt 1 contains phosphorus in a smaller amount in a back surface region and a front surface region than in an intermediate region in a thickness direction. The fixing belt 1 has the smaller micro Vickers hardness in the back surface region and the front surface region than in the intermediate region. The fixing belt 1 is provided with layers having the different hardness in the thickness direction of the nickel belt by changing a content of phosphorus. The content of phosphorus is increased to increase the micro Vickers hardness to obtain the durability in the central layer while the content of phosphorus is decreased to reduce the micro Vickers hardness to reduce a stress due to bending when the nickel belt is bent in the back surface and front surface layers. Also in the surface layer, the content of phosphorus is small, and thus, the occurrence of the surface defect may be inhibited. This realizes the fixing device 100 having the high durability by increasing the fatigue strength of the nickel belt.

Figure 4:
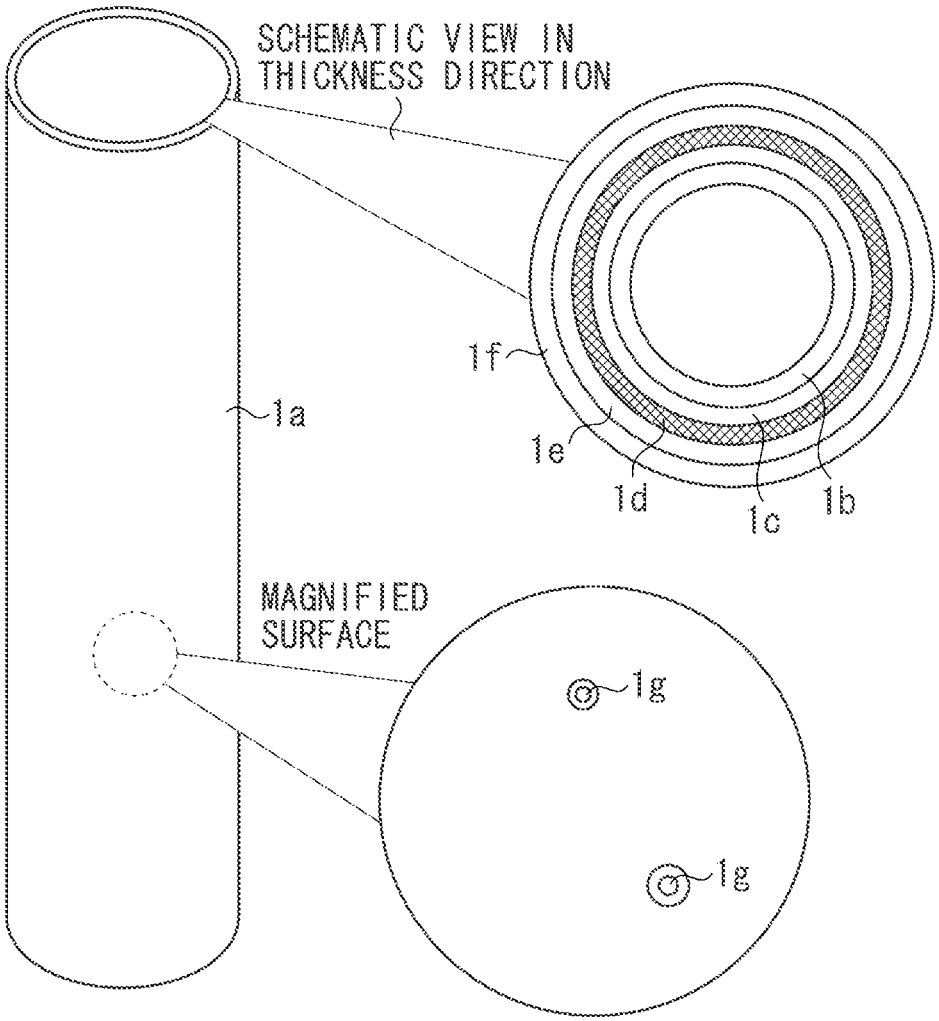
FIG. 4 is a view illustrating a configuration of a nickel belt according to a first exemplary embodiment.
Figure 5:
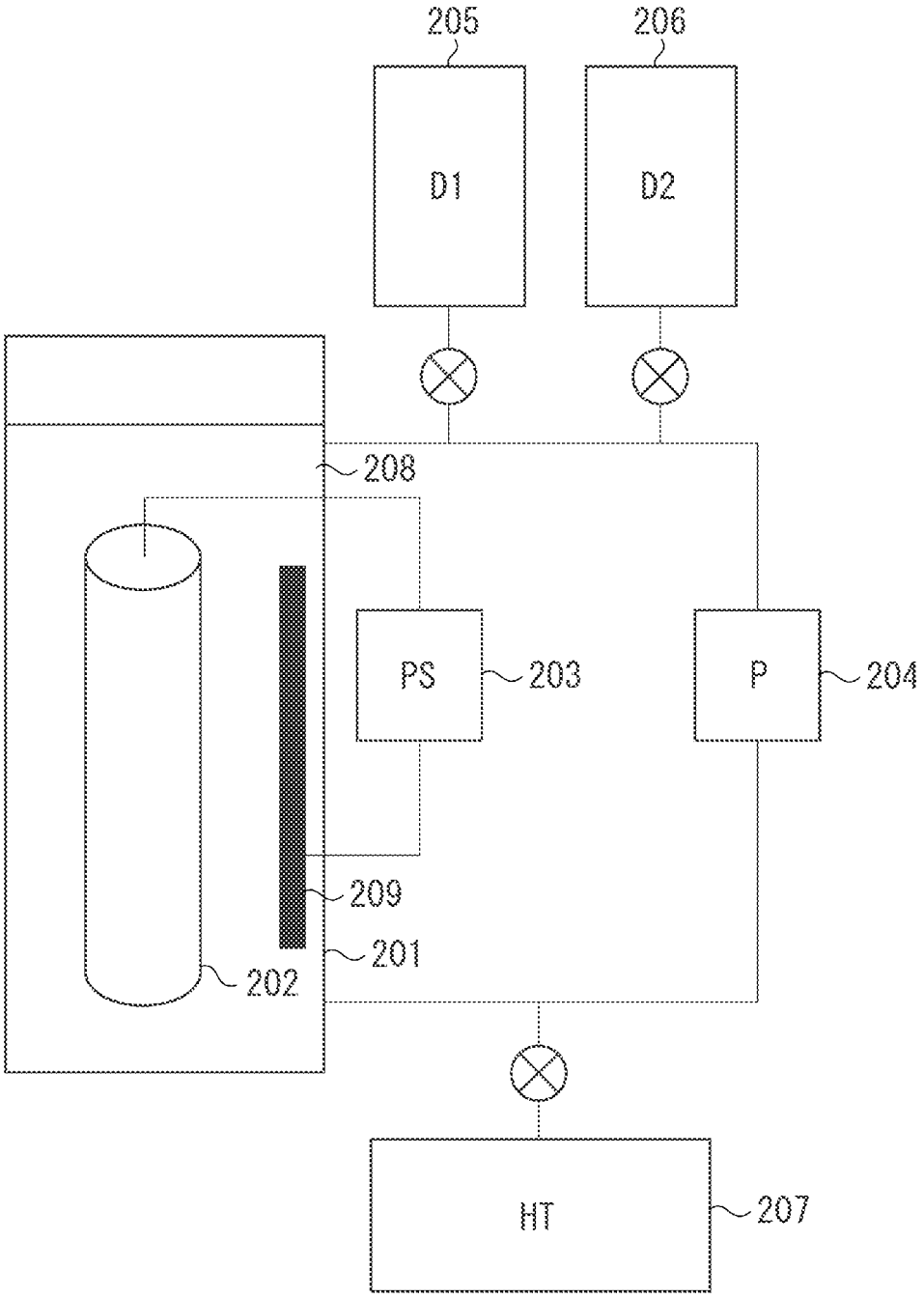
FIG. 5 is a schematic view illustrating the principle of an electrocasting method.

Hereinafter, a first exemplary embodiment will be described. FIG. 4 is a view illustrating a configuration of the nickel belt according to the first exemplary embodiment. FIG. 5 is a schematic view illustrating the principle of the electrocasting method. The thickness of each layer is exaggeratingly illustrated in the schematic view in the thickness direction in FIG. 4.

As illustrated in FIG. 3, the fixing belt 1 that is an example of a belt member for the image heating device is produced by the electrocasting method with an added element being added that enhances the hardness of a metal material of the base material, and rotates with contacting an image on the surface of the recording material. The metal material of the base material is nickel and the added element is phosphorus. The belt guide 2 that is an example of a supporting member is arranged non-rotatably to the inside of the fixing belt 1, and slides and frictionizes to the fixing belt 1. The belt guide 2 has a recording material separation unit that projects toward the elastic layer of the pressing roller 7 at a position adjacent to the outlet of the nip portion 14. The pressing roller 7 that is an example of a pressing rotating member is brought into press-contact with the belt guide 2 across the fixing belt 1 to form the nip portion 14 for the recording material together with the fixing belt 1. The pressing roller 7 is an elastic body roller having the elastic layer.

As illustrated in FIG. 4, in the base layer made of nickel in the fixing belt 1, a content rate of the added element in layers 1*b* and 1*f* that are an outermost layers is lower than that in layers 1*c*, 1*d*, and 1*e* that are located therebetween. Peak values of phosphorus detected by fluorescent X-ray analysis in the layers 1*b* and 1*f* that are the outermost layers are lower than peaks of phosphorus detected by the fluorescent X-ray analysis in the layers 1*c*, 1*d*, and 1*e* that are intermediary layers. Thus, the micro Vickers hardness measured in the layers 1*b* and 1*f* that are the outermost layers is smaller than the micro Vickers hardness measured in the layers 1*c*, 1*d*, and 1*e* that are located between the layers 1*b* and 1*f*.

In the first exemplary embodiment, the nickel belt, in which an amount of phosphorus is large near a center of the fixing belt in the thickness direction, and an amount of phosphorus near the back surface and the front surface is smaller than that near a center, is produced by changing the concentration of phosphorus in an electrolytic solution in a growing process of a precipitate layer in the nickel electrocasting.

The base layer 1*a* in the fixing belt 1 is a nickel belt having a multilayer structure. The base layer 1*a* includes a first layer (an innermost surface layer) 1*b*, a second layer (an intermediary layer) 1*c*, a third layer (an intermediary layer) 1*d*, a fourth layer (an intermediary layer) 1*e*, and a fifth layer (an outermost surface layer) 1*f*, which are different in phosphorus content, from the inside of the fixing belt 1. The respective thickness of the first layer 1*b*, the second layer 1*c*, the third layer 1*d*, the fourth layer 1*e*, and the fifth layer 1*f* are targeted to be 8 μm to set a current to be applied and a time period to be applied in the electrolytic solution. In the present exemplary embodiment, the base layer 1*a* may be the laminated structure of at least three or more layers.

A phosphorus content in each layer is obtained by the fluorescent X-ray analysis. The phosphorus contents in the first layer 1*b*, the second layer 1*c*, the third layer 1*d*, the fourth layer 1*e*, and the fifth layer 1*f* are 0.05%, 0.4%, 1.2%, 0.4%, and 0.05% by weight, respectively.

As illustrated in FIG. 5, the first layer (the innermost surface layer) 1*b* is grown on the surface of the cylindrical electrode by the electrocasting method using the electrolytic solution of the nickel ion, to which the phosphorus ion has been added, in a first step. In a second step, the second to fourth layers (the intermediary layers) 1*c* to 1*e* are grown on the first layer by the electrocasting method using an electrolytic solution of the nickel ion in which the concentration of the phosphorus ion is higher than that in the first step. In a third step, the fifth layer (the outermost surface layer) 1*f* is grown on the fourth layer (the intermediary layer) by the electrocasting method using an electrolytic solution of the nickel ion in which the concentration of the phosphorus ion is lower than that in the second step.

A weight ratio of phosphorus in the composition is 0.1% or less and the thickness is 5 μm or more in the first layer (the innermost surface layer) formed in the first step and the fifth layer (the outermost surface layer) formed in the third step. A maximum value of the weight ratio of phosphorus in the composition is 1% or more in the second to fourth layers (the intermediary layers) formed in the second step.

In the first exemplary embodiment, the phosphorus content in each layer is controlled by changing the concentration of phosphorus in the electrolytic solution in the growth process of each layer by the electrocasting method. More specifically, the phosphorus content in the electrolytic solution 208 is controlled by automatically controlling a supply amount of a nickel electrolytic solution 205, a supply amount of a phosphorus-containing nickel electrolytic solution 206 for an electrolysis chamber 201, and a collection amount in a waste tank 207. Thus, the phosphorus content is continuously changed between the respective laminated layers. A power supply 203 applies an electric current between a carbon cylindrical electrode 202 and a circumferential electrode 209 to grow a nickel metal layer on the surface of the cylindrical electrode 202.

The surface of the base layer 1*a* in the produced nickel belt was observed under a microscope, and two defects of 20 μm or less could be found as defects 1*g*.

Subsequently, the base layer 1*a* in the nickel belt is burned in a furnace at 250° C. for one hour. The micro Vickers hardness of a back surface region and a front surface region in the nickel belt was measured and was about 510 HV both in the back surface region and the front surface region. This value is lower than the micro Vickers hardness of about 660 HV in the base layer containing phosphorus at a concentration of 0.42% by weight in a comparative example 2 to be described below.

A fixing belt 1 was produced using the base layer 1*a* of the nickel belt, the fixing belt 1 was mounted onto the fixing device 100, and a paper passing test was conducted using 600,000 sheets of paper. As a result, no crack occurred in the fixing belt and a good fixability could be satisfied.

Differently from comparative examples 1 and 2 to be described below, the nickel belt according to the first embodiment can prevent or reduce fatigue failure due to accumulation of the metal fatigue caused by the repeated sequential bending/reverse bending as illustrated in FIG. 3. Compared with the comparative examples 1 and 2 to be described below, in the nickel belt according to the first exemplary embodiment, when bending occurs in the fixing belt 1, the hardness of the back surface region and the front surface region, in which the strain becomes the largest, is low, and thus, the stress due to the bending becomes small. Here, the hardness of the third layer 1*d*, in which the concentration of phosphorus is high, seems to be high. However, the strain is difficult to occur when the bending occurs in the fixing belt 1 because the third layer 1*d* is located near a centerline. Thus, the stress level is conceivable to be low.

Therefore, the nickel belt according to the first exemplary embodiment can receive a benefit alone for enhancing the fatigue strength by increasing the hardness of the intermediary layers, and enhances the durability. In addition, the concentration of phosphorus in the front surface region is lower than that in the comparative example 2 to be described below. Thus, there is less surface defect, and bending can be repeated without the stress concentrating due to the bending. Thus, the good fixability for a long period of time appears to be maintained.

In the first exemplary embodiment, the amount of phosphorus near a center in the thickness direction is large and the amounts of phosphorus near the back surface and the front surface are smaller than that near a center by changing the concentration of phosphorus in the electrolytic solution in the growth process with the nickel electrocasting. The hardness is increased to obtain the durability by increasing the phosphorus content of the nickel belt near a center in the thickness direction. The increase of the hardness of the back surface and the front surface is reduced to reduce the stress due to bending when the belt is bent, by making the amount of phosphorus near the back surface and the front surface smaller than that near the center. The durability is obtained by increasing the amount of phosphorus of the base layer 1*a* in the fixing belt 1 near a center in the thickness direction to increase the hardness in the center part. By decreasing the amount of phosphorus near the back surface and the front surface, the increase of the hardness of the back surface and the front surface may be reduced to reduce the stress due to the bending when the belt is bent. Also, the occurrence of the surface defect may be reduced because the amount of phosphorus near the front surface is small. This can realize the fixing belt with high durability.

On the other hand, in the comparative example 2 to be described below, the hardness may be increased to enhance the durability by phosphorus being contained in the electrolytic solution in the nickel electrocasting. However, the stress due to the bending is increased when the belt is bent whereas the hardness of the belt increases. Thus, the crack easily occurs due to the accumulation of the metal fatigue.

In the first exemplary embodiment, a durability life is evaluated using a fixing device of IH one-drop-filling (ODF) that employs an electromagnetic induction heating system. However, also in a fixing device using a ceramic heater in place of the IH heater, the similar good fixability may be kept for a long period of time under an environment, in which the belt is repeatedly exposed to the sequential bending and the reverse bending as illustrated in FIG. 3.

In the first exemplary embodiment, the configuration in which phosphorus is contained in the innermost layer 1*b* and the outermost layer 1*f* of the nickel belt is described, but it is possible to employ a configuration as follows. That is, the layer configuration in which phosphorus is not contained in at least one of the innermost layer 1*b* and the outermost layer 1*f* of the nickel belt may be employed. Also, a configuration in which phosphorus is contained in the innermost layer 1*b* of the nickel belt with the above condition being satisfied whereas phosphorus is not contained in the outermost layer 1*f* of the nickel belt may be employed.

The added element is phosphorus in the first exemplary embodiment, but the added element, such as bismuth, arsenic salts, and germanium, may give the similar effect.

Comparative Example 1

Figure 6:
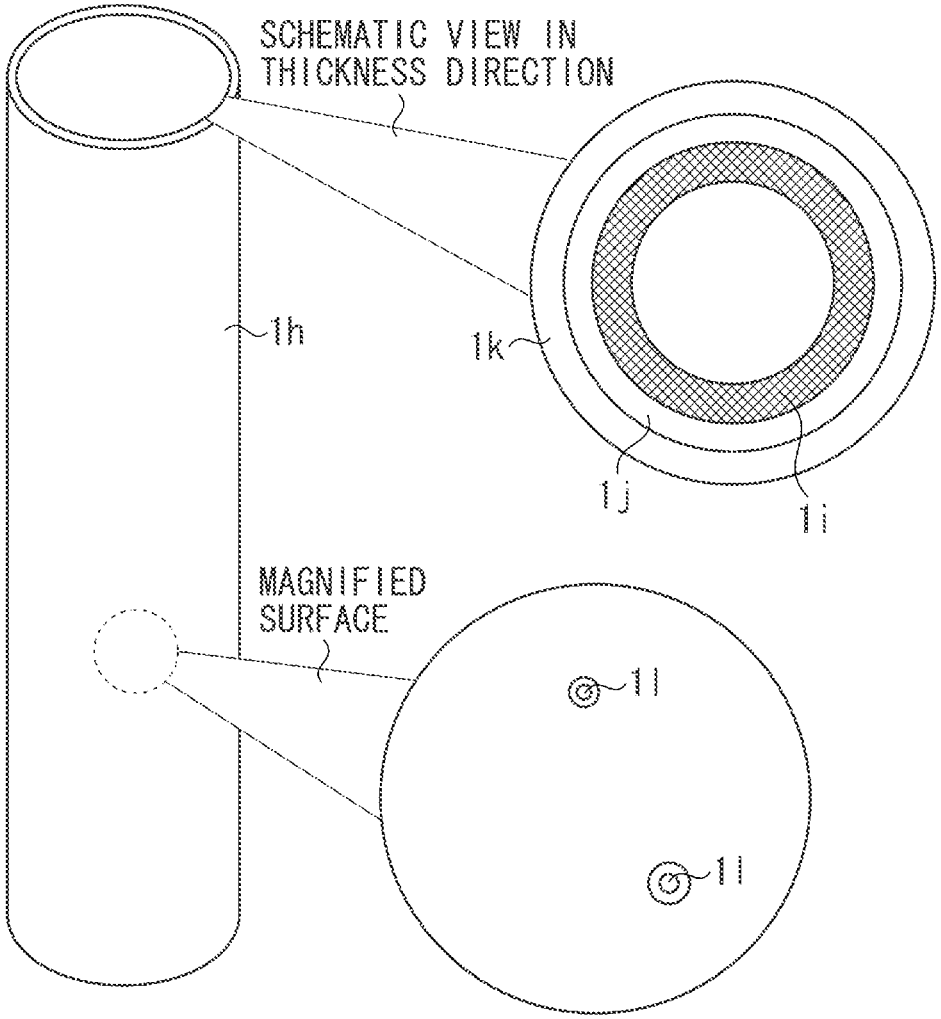
FIG. 6 is a view illustrating a configuration of a nickel belt according to a comparative example 1.

FIG. 6 is a view illustrating a configuration of a nickel belt according to a comparative example 1. As illustrated in FIG. 6, a base layer 1*h* in the nickel belt according to the comparative example 1 includes a first layer 1*i*, a second layer 1*j*, and a third layer 1*k*, which are different in phosphorus concentration, from the inside of the belt. The thickness of the first layer 1*i*, the second layer 1*j*, and the third layer 1*k* are 14 μm, 13 μm, and 13 μm, respectively. The phosphorus content in each layer in the nickel belt is controlled by the phosphorus concentration in the electrolytic solution being changed in the growth process in the nickel electrocasting in the similar manner as in the first exemplary embodiment.

The phosphorus content in each layer is obtained by the fluorescent X-ray analysis. The phosphorus contents in the first layer 1*i*, the second layer 1*j*, and the third layer 1*k* are 0.8%, 0.4%, and 0.05% by weight, respectively. The surface of the produced base layer 1*h* in the nickel belt according to the comparative example 1 was observed under the microscope, the surface defect 11 on the belt was almost the same as that in the first exemplary embodiment.

The base layer 1*h* in the nickel belt is burned in the furnace at 250° C. for one hour. The micro Vickers hardness in the back surface region and the front surface region of the nickel belt was measured and was about 720° in the back surface region and about 510° in the front surface region.

A fixing belt 1 was produced using the base layer 1*h* of the nickel belt, the fixing belt 1 was mounted onto the fixing device 100, and the paper passing test was conducted in the same condition as in the first exemplary embodiment. In the comparative example 1, when 400,000 sheets of paper were passed, the crack occurred on the fixing belt 1 to cause the fixing failure. It is conceivable that, when the fixing belt 1 is bent, the stress due to the bending becomes high because the hardness of the back surface region is high, thereby the metal fatigue gradually accumulates to cause the crack.

Comparative Example 2

Figure 7:
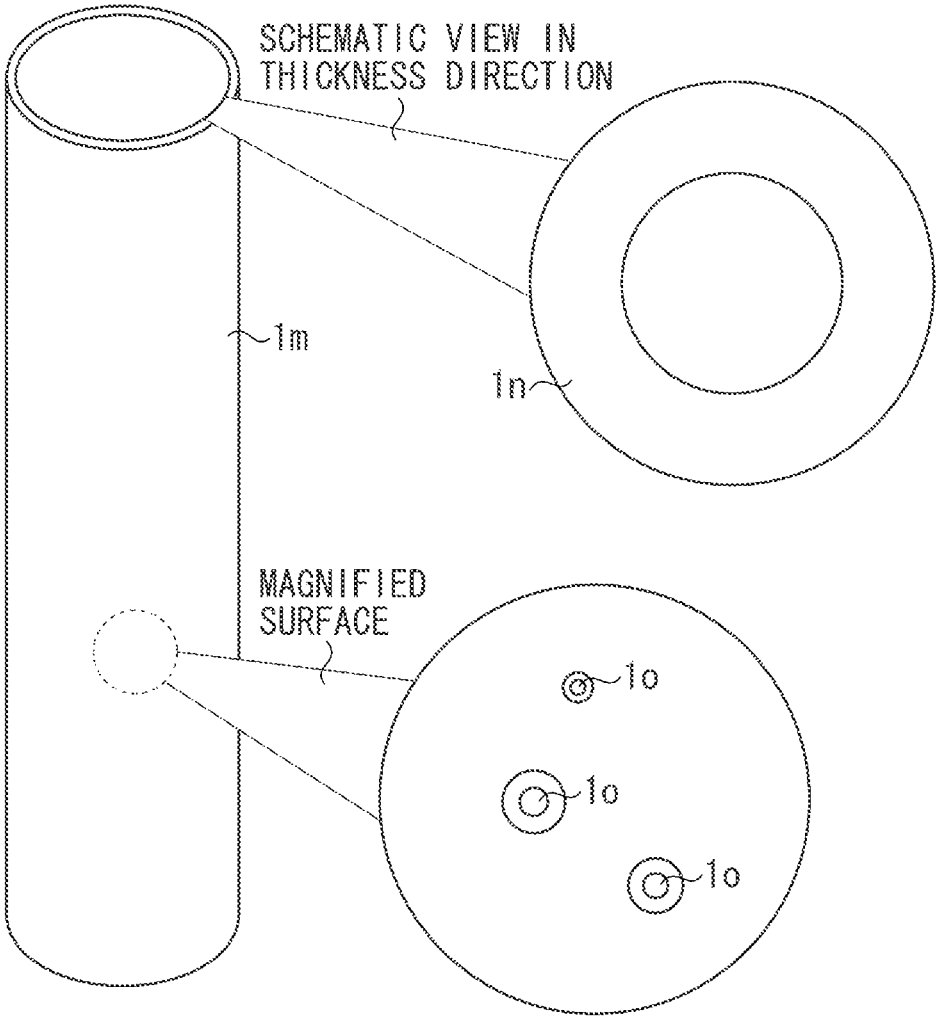
FIG. 7 is a view illustrating a configuration of a nickel belt according to a comparative example 2.

FIG. 7 is a view illustrating a configuration of a nickel belt according to the comparative example 2. As illustrated in FIG. 7, a base layer 1*m* of the nickel belt includes a first layer in alone because a phosphorus concentration is kept constant in the electrolytic solution in the growth process in the nickel electrocasting. A process for the nickel electrocasting is controlled so that the phosphorus content in the first layer in is 0.42% by weight.

The surface of the base layer in in the produced nickel belt was observed under the microscope, and four defects of 80 μm or more were found as the surface defect 1*o*. Compared with the first exemplary embodiment, a size of the defect is larger and the number thereof is larger in the comparative example 2. The base layer in in the nickel belt according to the comparative example 2 is burned in the furnace at 250° C. for one hour. The micro Vickers hardness in the back surface region and the front surface region of the nickel belt was measured and was about 660° in both the back surface region and the front surface region.

In the comparative example 2, the paper passing test was conducted in the same manner as in the first exemplary embodiment. When 250,000 sheets of paper were passed, the crack occurred on the fixing belt 1 to cause the fixing failure. The cracked portion was observed under an electron microscope, and evidence that the crack grew from the surface defect as a start point was observed. From this observation, it is thought that when the fixing belt 1 is bent, the stress due to the bending concentrates in a portion of the surface defect to cause the crack.

Figure 8:
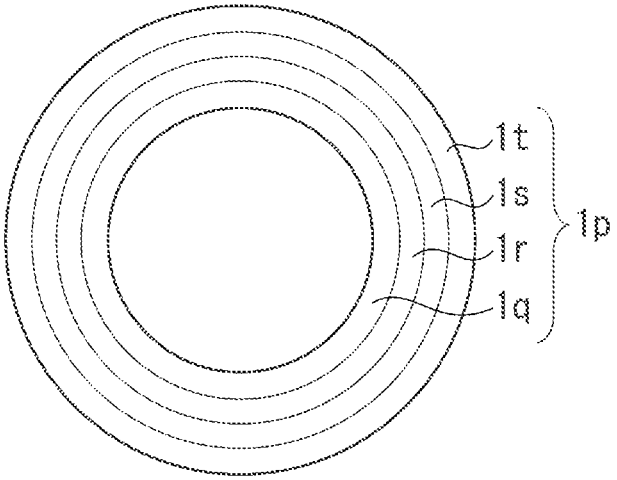
FIG. 8 is a view illustrating a configuration of a nickel belt according to a second exemplary embodiment.

FIG. 8 is a view illustrating a nickel belt according to a second exemplary embodiment. FIG. 8 is a schematic view illustrating the nickel belt in the thickness direction, and the thickness of each layer is exaggeratingly illustrated.

As illustrated in FIG. 8, in the second exemplary embodiment, a base layer ip of the nickel belt is produced by changing the concentration of phosphorus in the electrolytic solution in the growth process of each layer in the nickel electrocasting method. By this procedure, the base layer 1*p* includes four layers, i.e., a first layer 1*q*, a second layer 1*r*, a third layer is, and a fourth layer it, which are different in phosphorus content, from the inside of the belt. Difference from the first exemplary embodiment is that bending resistant differences between a silicon rubber layer (an elastic layer) and a PFA resin tube (a topmost-surface layer) when the fixing belt 1 is bent are added to shift the layer having the higher phosphorus content to a front surface side. The phosphorus contents in the first layer 1*q*, the second layer 1*r*, the third layer is, and the fourth layer it are 0.05%, 0.3%, 1.0%, and 0.4% by weight, respectively.

The surface of the base layer 1*p* of the produced nickel belt was observed under the microscope, and three surface defects (equivalent to FIG. 4: 1*g*) of 30 μm or less could be found on the entire circumferential surface. The base layer ip in the nickel belt is burned in the furnace at 250° C. for one hour. The micro Vickers hardness in the back surface region and the front surface region of the nickel belt was measured and was about 510 HV in the back surface region and about 560 HV in the front surface region.

A fixing belt 1 was produced using the base layer 1*p* of the nickel belt formed as above, and the paper passing test using 600,000 sheets of paper was conducted under the same condition as in the first exemplary embodiment. As a result, no crack occurred on the fixing belt 1 and the good fixability could be satisfied similarly to the first exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-086031 filed Apr. 5, 2012, which is hereby incorporated by reference herein in its entirety.

What is claimed is:

1. An endless belt for fixing, the endless belt comprising:

a base layer including a first layer, a second layer, and a third layer disposed between the first layer and the second layer, each of which are made of nickel; and a toner parting layer provided on the base layer, wherein a content rate of phosphorus in the first layer and the second layer is lower than that in the third layer.

2. The endless belt according to claim 1, wherein micro Vickers hardness in the first layer and the second layer is smaller than that in the third layer.

3. The endless belt according to claim 2, wherein the first layer and the second layer constitute an outmost layer in the base layer.

4. The endless belt according to claim 1, further comprising an elastic layer provided between the base layer and the toner parting layer.

5. A fixing device comprising:

an endless belt that heats a toner image on a recording material at a nip portion, wherein the endless belt includes a base layer and a toner parting layer provided on the base layer; and a rotating member that forms the nip portion together with the endless belt, wherein the base layer includes a first layer, a second layer, and a third layer disposed between the first layer and the second layer, each of which are made of nickel, and wherein a content rate of phosphorus in the first layer and the second layer is lower than that in the third layer.

6. The fixing device according to claim 5, wherein micro Vickers hardness in the first layer and the second layer is smaller than that in the third layer.

7. The fixing device according to claim 6, wherein the first layer and the second layer constitute an outmost layer in the base layer.

8. The fixing device according to claim 5, wherein the endless belt further includes an elastic layer provided between the base layer and the toner parting layer.

9. A method for producing an endless belt for fixing, the method comprising:

providing a base layer by including an innermost surface layer, an outermost surface layer, and an intermediary layer disposed between the innermost surface layer and the outermost surface layer, each of which are made of nickel ion; and providing a toner parting layer on the base layer, wherein a content rate of phosphorus ion in the innermost surface layer and the outermost surface layer is lower than that in the intermediary layer.

10. The method according to claim 9, wherein the innermost surface layer and the outermost surface layer are provided so that a weight ratio of phosphorus ion in a composition of nickel ion to which the phosphorus ion has been added is 0.1% or less and a thickness is 5 μm or more in the providing of the innermost surface layer and the outermost surface layer, and wherein the intermediary layer is provided so that a maximum value of a weight ratio of phosphorus ion in the composition is 1% or more in the providing of the intermediary layer.

11. An endless belt for fixing, the endless belt comprising:

a base layer including an innermost surface layer, an outermost surface layer, and an intermediary layer disposed between the innermost surface layer and the outermost surface layer, each of which are made of nickel; and a toner parting layer provided on the base layer, wherein the intermediary layer includes added phosphorus whereas the innermost surface layer and the outermost surface layer do not include added phosphorus.

12. The endless belt according to claim 11, wherein micro Vickers hardness in the innermost surface layer and the outermost surface layer is smaller than that in the intermediary layer.

13. The endless belt according to claim 11, further comprising an elastic layer provided between the base layer and the toner parting layer.

14. A fixing device comprising:

an endless belt that heats a toner image on a recording material at a nip portion, wherein the endless belt includes a base layer and a toner parting layer provided on the base layer; and a rotating member that forms the nip portion together with the endless belt, wherein the base layer includes an innermost surface layer, an outermost surface layer, and an intermediary layer disposed between the innermost surface layer and the outermost surface layer, each of which are made of nickel, and wherein the intermediary layer includes added phosphorus whereas the innermost surface layer and the outermost surface layer do not include added phosphorus.

15. The fixing device according to claim 14, wherein micro Vickers hardness in the innermost surface layer and the outermost surface layer is smaller than that in the intermediary layer.

16. The fixing device according to claim 14, wherein the endless belt further includes an elastic layer provided between the base layer and the toner parting layer.

17. An endless belt for fixing comprising:

a base layer made of nickel, wherein the base layer includes an innermost surface layer, an outermost surface layer, and an intermediary layer disposed between the innermost surface layer and the outermost surface layer; and a toner parting layer provided on the base layer, wherein the innermost surface layer and the intermediary layer include added phosphorus and the outermost surface layer does not include added phosphorus.

18. The endless belt according to claim 17, wherein micro Vickers hardness in the outermost surface layer is smaller than that in the innermost surface layer and the intermediary layer.

19. The endless belt according to claim 17, further comprising an elastic layer provided on the outermost surface layer in the base layer, wherein the toner parting layer is provided on the elastic layer.

20. A fixing device comprising:

an endless belt that heats a toner image on a recording material at a nip portion, wherein the endless belt includes a base layer made of nickel and a toner parting layer provided on the base layer; and a rotating member that forms the nip portion together with the endless belt wherein the base layer includes an innermost surface layer, an outermost surface layer, and an intermediary layer disposed between the innermost surface layer and the outermost surface layer, and wherein the innermost surface layer and the intermediary layer include added phosphorus and the outermost surface layer does not include added phosphorus.

21. The fixing device according to claim 20, wherein micro Vickers hardness in the outermost surface layer is smaller than that in the innermost surface layer and the intermediary layer.

22. The fixing device according to claim 20, wherein the endless belt further includes an elastic layer provided on the outermost surface layer in the base layer, and wherein the toner parting layer is provided on the elastic layer.

* * * * *